US008956198B1

(12) United States Patent
Chang et al.

(10) Patent No.: US 8,956,198 B1
(45) Date of Patent: Feb. 17, 2015

(54) WALKING TOY

(75) Inventors: Kin Fai Chang, Kowloon (HK); Louis Luk, Hong Kong (HK)

(73) Assignee: Mattel, Inc., El Segundo, CA (US)

( * ) Notice: Subject to any disclaimer, the term of this patent is extended or adjusted under 35 U.S.C. 154(b) by 374 days.

(21) Appl. No.: 13/246,427

(22) Filed: Sep. 27, 2011

Related U.S. Application Data

(60) Provisional application No. 61/386,803, filed on Sep. 27, 2010.

(51) Int. Cl.
*A63H 17/14* (2006.01)

(52) U.S. Cl.
USPC ..... 446/433

(58) Field of Classification Search
CPC ..... A63H 13/04; A63H 5/00; A63H 13/02
USPC ..... 446/330, 355, 353
See application file for complete search history.

(56) References Cited

U.S. PATENT DOCUMENTS

| | | | | |
|---|---|---|---|---|
| 2,667,719 | A | 2/1954 | Edwardson | |
| 3,128,575 | A | 4/1964 | Stanetzki | |
| 3,267,608 | A | 8/1966 | Ryan | |
| 3,421,258 | A | 1/1969 | Gardel et al. | |
| 3,445,960 | A | 5/1969 | Ryan | |
| 3,543,435 | A | 12/1970 | Giroud | |
| 3,582,079 | A | 6/1971 | Breslow | |
| 3,583,098 | A | 6/1971 | Bear et al. | |
| 3,596,398 | A | 8/1971 | Gardel et al. | |
| 3,660,931 | A | 5/1972 | Gardel et al. | |
| 3,665,644 | A | 5/1972 | Rapp | |
| 3,704,543 | A | 12/1972 | Giroud | |
| 4,302,903 | A | 12/1981 | Pun | |
| 4,365,437 | A | 12/1982 | Jameson | |
| 4,555,237 | A | 11/1985 | Nikaido | |
| 4,613,315 | A | 9/1986 | Kataoka | |
| 4,795,395 | A | 1/1989 | Oishi et al. | |
| 4,944,708 | A | 7/1990 | Kawabe | |
| 5,045,015 | A | 9/1991 | Arad et al. | |
| 5,088,954 | A | 2/1992 | Terzian et al. | |
| 5,158,493 | A * | 10/1992 | Morgrey | 446/355 |
| 5,224,896 | A | 7/1993 | Terzian | |
| 5,238,441 | A | 8/1993 | Llorens | |
| 5,326,302 | A | 7/1994 | Llorens | |

(Continued)

FOREIGN PATENT DOCUMENTS

| | | |
|---|---|---|
| EP | 0201626 | 11/1986 |
| GB | 2045625 | 3/1980 |

(Continued)

*Primary Examiner* — Michael Dennis
(74) *Attorney, Agent, or Firm* — Cantor Colburn LLP

(57) ABSTRACT

Disclosed herein is a toy, the toy having: a main body portion; a first leg pivotally secured to the main body portion for reciprocating movement between a forward position and a rearward position with respect to the main body portion; a first foot pivotally secured to the first leg; a second leg pivotally secured to the main body portion for reciprocating movement between a forward position and a rearward position with respect to the main body portion; and a second foot pivotally secured to the second leg, wherein the first foot is spring biased with respect to the first leg and the second foot is spring biased with respect to the second leg such that a center of mass of the toy is intermittently aligned with and supported solely by either the first foot or the second foot as the first leg and the second leg move between the forward position and the rearward position.

13 Claims, 10 Drawing Sheets

(56) References Cited

U.S. PATENT DOCUMENTS

| | | | | |
|---|---|---|---|---|
| 5,628,668 | A | 5/1997 | Takemae | |
| 6,095,887 | A | 8/2000 | Llorens | |
| 6,149,491 | A | 11/2000 | Arad et al. | |
| 6,200,191 | B1 | 3/2001 | Chou | |
| 6,462,498 | B1 | 10/2002 | Filo | |
| 6,602,106 | B2 | 8/2003 | Cheung | |
| 6,620,021 | B2 | 9/2003 | Liu | |
| 6,629,871 | B1 | 10/2003 | Liu | |
| 6,645,036 | B1 | 11/2003 | Lund et al. | |
| 6,752,683 | B1 | 6/2004 | Godfrey | |
| 6,918,811 | B1 * | 7/2005 | Wang | 446/373 |
| 7,163,430 | B1 | 1/2007 | Lund et al. | |
| 7,238,079 | B2 | 7/2007 | Madhani et al. | |
| 7,270,590 | B2 | 9/2007 | Marine et al. | |
| 7,338,341 | B2 | 3/2008 | Hoeting et al. | |
| 2002/0193045 | A1 * | 12/2002 | Lee et al. | 446/330 |
| 2003/0017779 | A1 | 1/2003 | Sakai | |
| 2003/0017780 | A1 | 1/2003 | Cheung | |
| 2003/0092353 | A1 | 5/2003 | Liu | |
| 2004/0127141 | A1 | 7/2004 | Sakai | |
| 2004/0219861 | A1 | 11/2004 | Madhani et al. | |

FOREIGN PATENT DOCUMENTS

| | | |
|---|---|---|
| GB | 2150451 | 7/1985 |
| GB | 2163059 | 2/1986 |
| GB | 2215223 | 9/1989 |
| GB | 2250214 | 6/1992 |
| JP | 2001259245 | 9/2001 |
| JP | 2004129957 | 4/2004 |
| JP | 2004154183 | 6/2004 |
| JP | 2006006626 | 1/2006 |
| JP | 2006218550 | 8/2006 |
| JP | 2006280405 | 10/2006 |

* cited by examiner

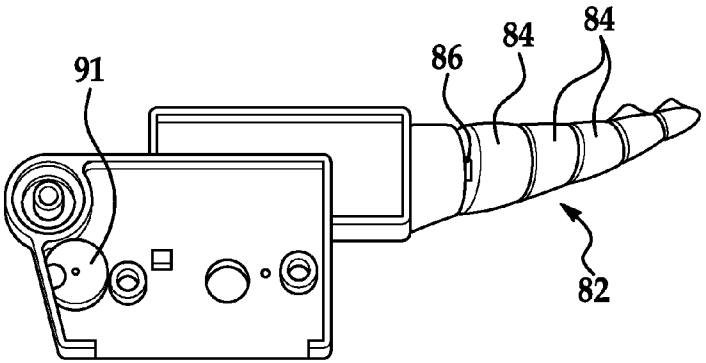
FIG. 3B
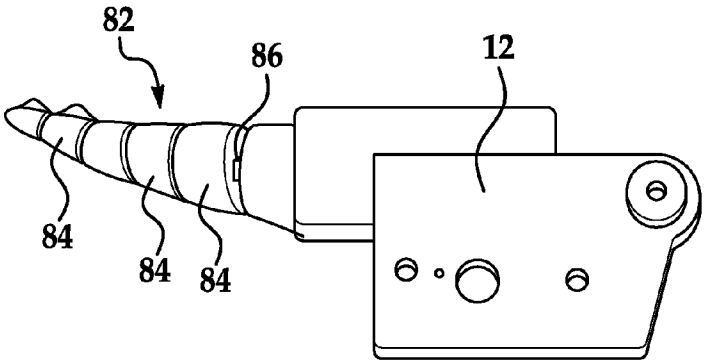
FIG. 3A
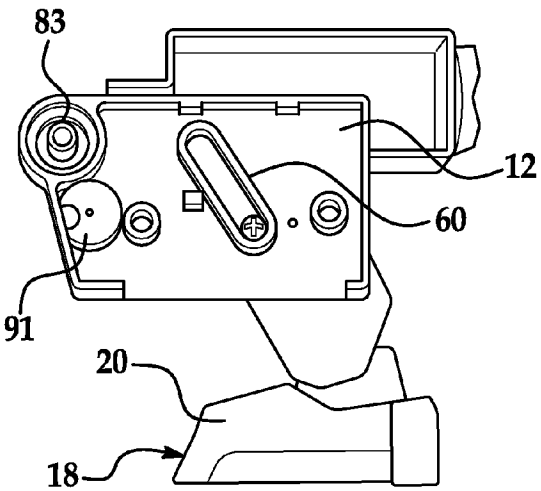
FIG. 4B
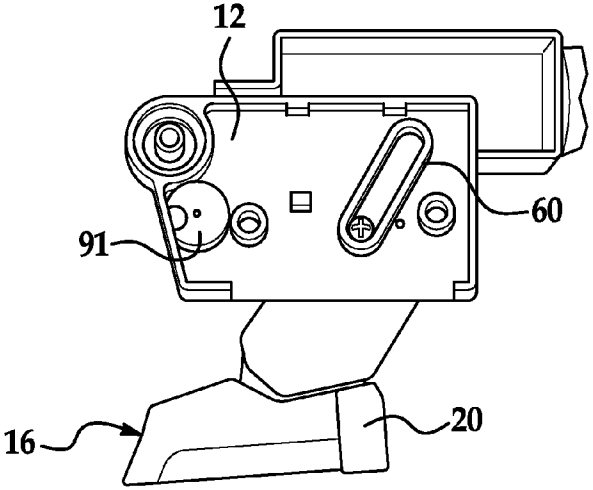
FIG. 4A
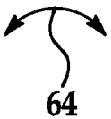

WALKING TOY

CROSS REFERENCE TO RELATED APPLICATIONS

This application claims the benefit of U.S. Provisional Patent Application Ser. No. 61/386,803, filed Sep. 27, 2010, the contents of which are incorporated herein by reference thereto.

BACKGROUND

Various embodiments of the present invention relate to a toy and more particularly, a movable or walking toy figure.

Children's toys have included miniature figures, characters, etc. furthermore certain children's toys have been configured to move or walk on their own to resemble a realistic toy.

Accordingly, it is desirable to provide a toy that employs an efficient means for self propelling the toy on a surface.

SUMMARY OF THE INVENTION

In one embodiment, a toy is provided. The toy having: a main body portion; a first leg pivotally secured to the main body portion for reciprocating movement between a forward position and a rearward position with respect to the main body portion; a first foot pivotally secured to the first leg; a second leg pivotally secured to the main body portion for reciprocating movement between a forward position and a rearward position with respect to the main body portion; and a second foot pivotally secured to the second leg, wherein the first foot is spring biased with respect to the first leg and the second foot is spring biased with respect to the second leg such that a center of mass of the toy is intermittently aligned with and supported solely by either the first foot or the second foot as the first leg and the second leg move between the forward position and the rearward position.

In another embodiment, a method of shifting a center of mass of a walking toy from a left foot to a right foot as the walking toy is intermittently supported only by either the right foot or the left foot, the method including the steps of: pivotally securing a right leg to a main body portion of the walking toy for reciprocating movement between a forward position and a rearward position with respect to the main body portion; pivotally securing the right foot to the right leg; pivotally securing a left leg to the main body portion of the walking toy for reciprocating movement between a forward position and a rearward position with respect to the main body portion; pivotally securing the left foot to the left leg, wherein the right foot is spring biased with respect to the right leg and the left foot is spring biased with respect to the left leg such that the center of mass of the toy is intermittently aligned with and supported by either the right foot or the left foot as the right leg and the left leg move between the forward position and the rearward position.

BRIEF DESCRIPTION OF THE DRAWINGS

Other features, advantages and details appear, by way of example only, in the following description of embodiments, the description referring to the drawings in which:

FIGS. 3A and 3B are views of component parts of a toy constructed in one embodiment of the present invention;

FIGS. 4A and 4B are views illustrating a forward position and rearward position of a leg of the toy in one embodiment of the present invention;

DETAILED DESCRIPTION

In accordance with various embodiments of the present invention a walking toy 10 is provided. In one exemplary embodiment the walking toy is self propelled and is capable of maintaining balance while walking and/or running by moving two legs pivotally secured to the toy. Toy 10 may be formed out of an easily molded material such as plastic or any other equivalent materials.

In one exemplary embodiment, the walking toy is driven forward by a motor configured to rotate/pivot the legs in a bipedal fashion. The walking action of the toy consists of supporting the weight of the body upon one leg while the other leg is swung to a forward position. The free leg or unsupported leg while moving to its forward position is capable of being bent at the ankle outward and the bottom of each leg or foot is inclined at a certain angle, thereby providing balance while the toy walks on the two legs.

Figure 1A:
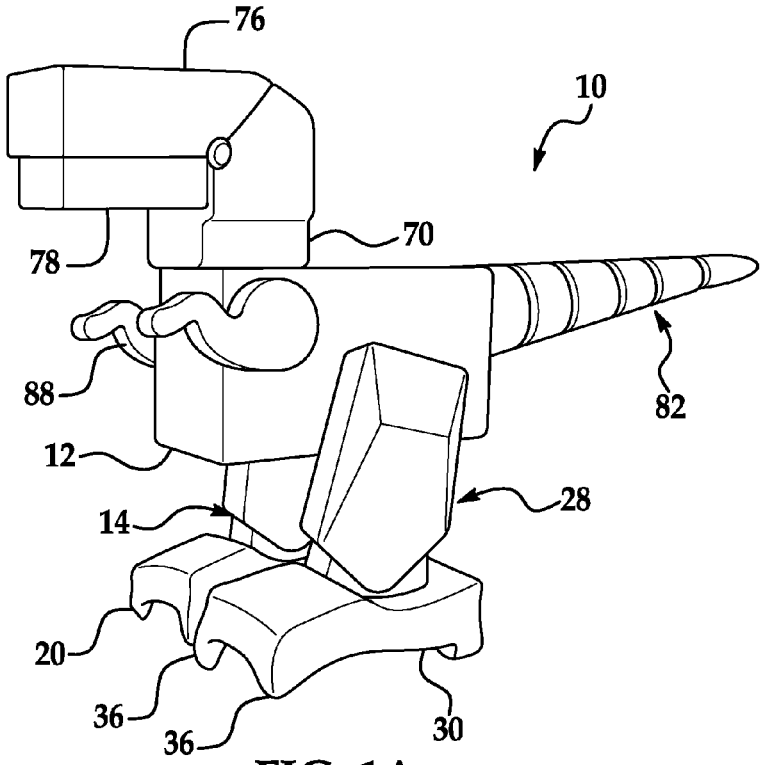
FIGS. 1A-1E are perspective views of a toy walking in accordance with one exemplary embodiment of the present invention.
Figure 1B:
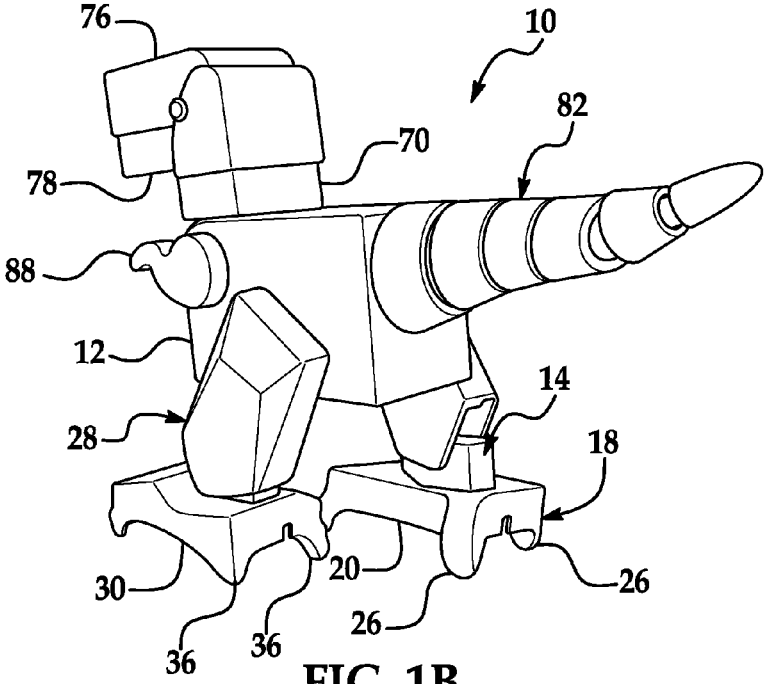
Figure 1D:
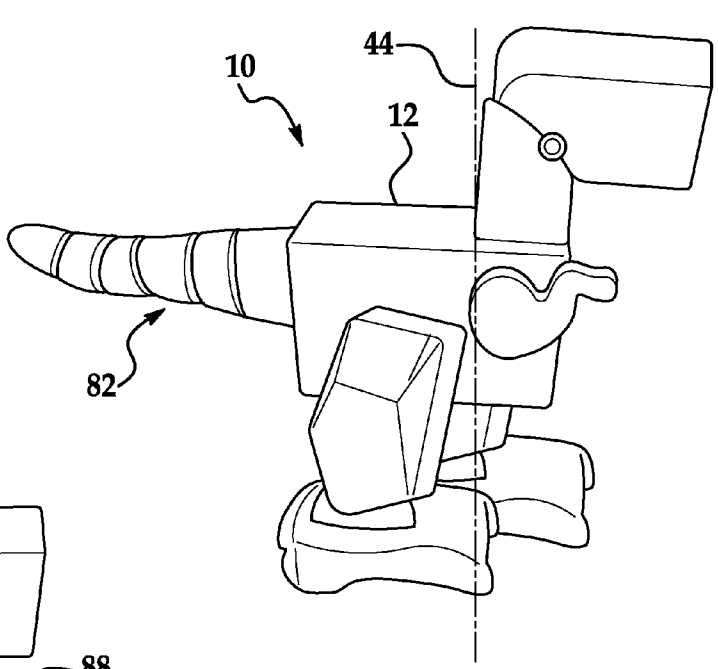
Figure 1C:
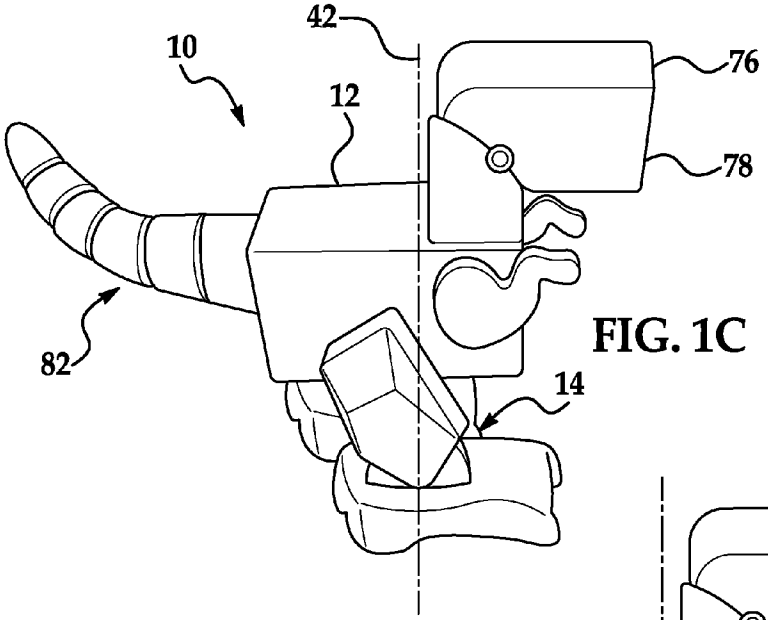
Figure 1E:
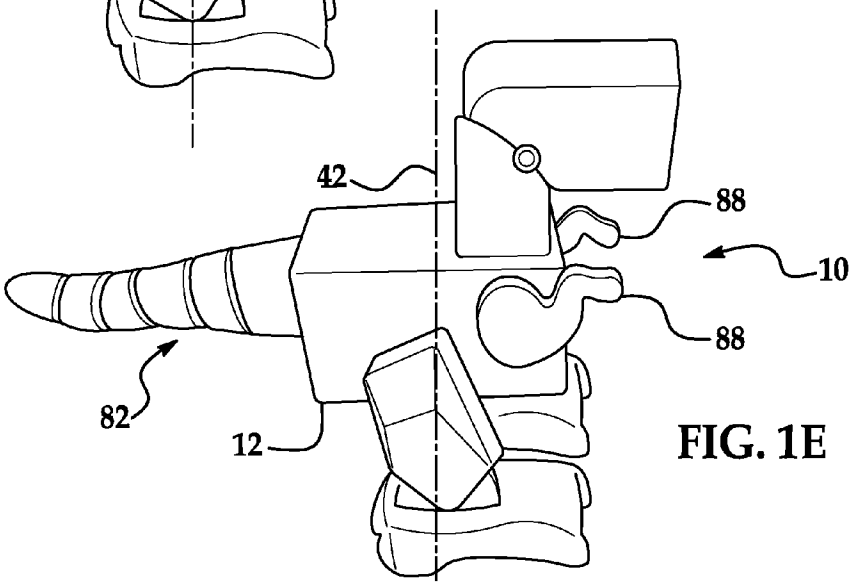
Figure 2A:
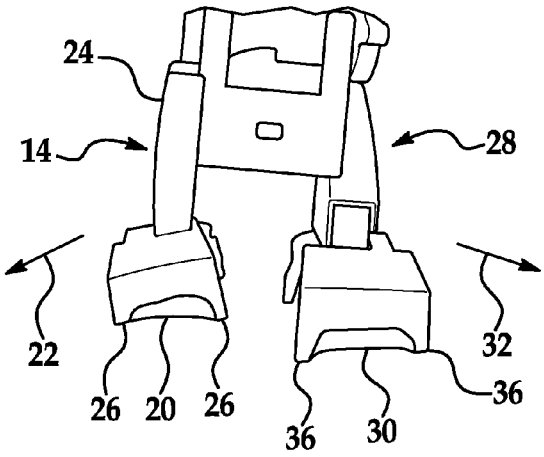
FIGS. 2A-2C are forward views of the legs of the toy as it is walking in accordance with one exemplary embodiment of the present invention.
Figure 6A:
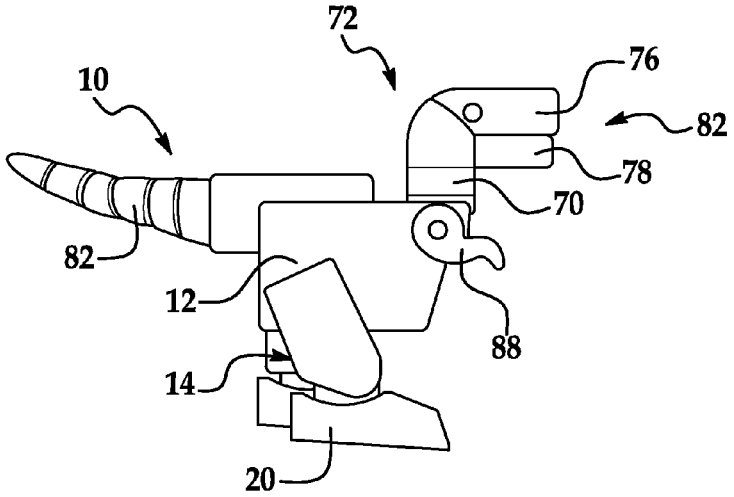
FIGS. 6A and 6B illustrate a neck member of the toy in an upright and extended position.
Figure 6B:
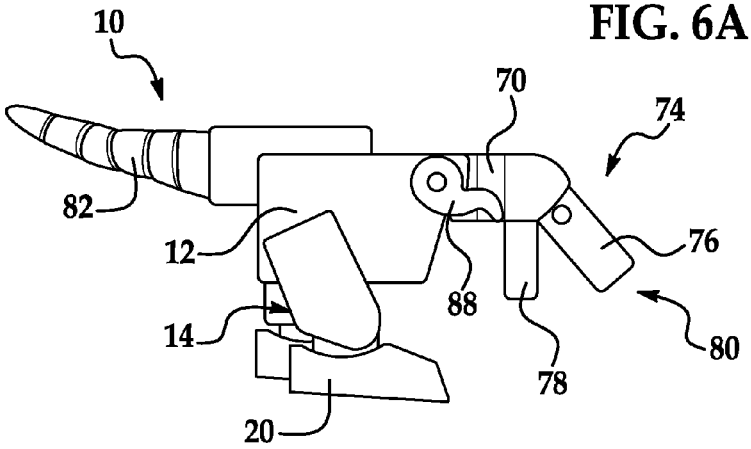
Figure 7A:
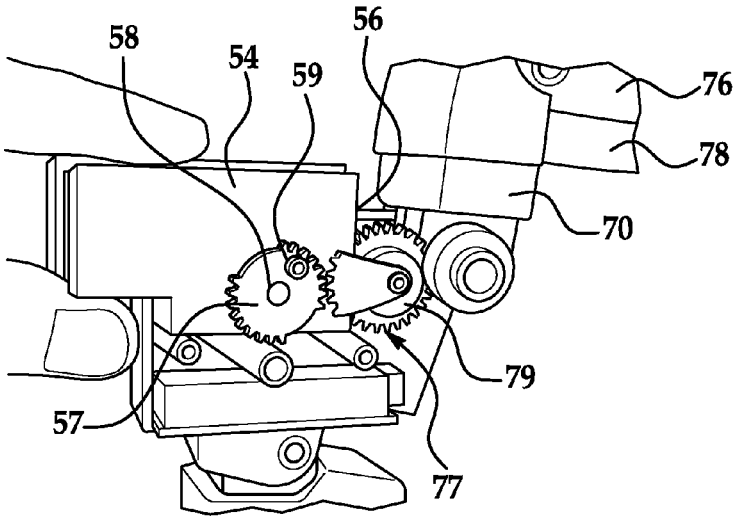
FIGS. 7A-7E are views illustrating components of the toy constructed in an exemplary embodiment of the present invention.
Figure 7B:
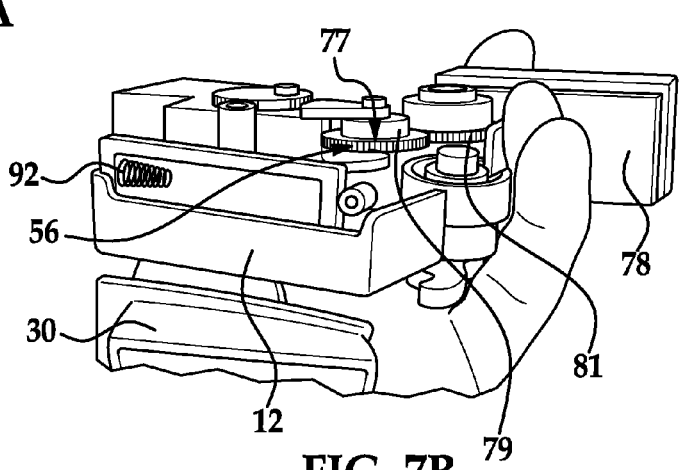
Figure 7C:
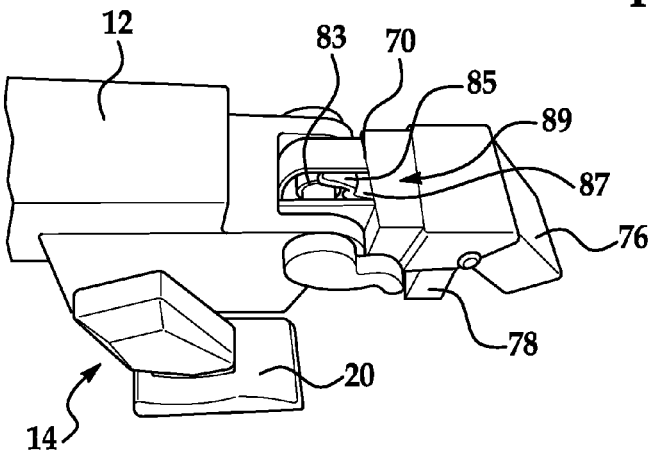
Figure 7D:
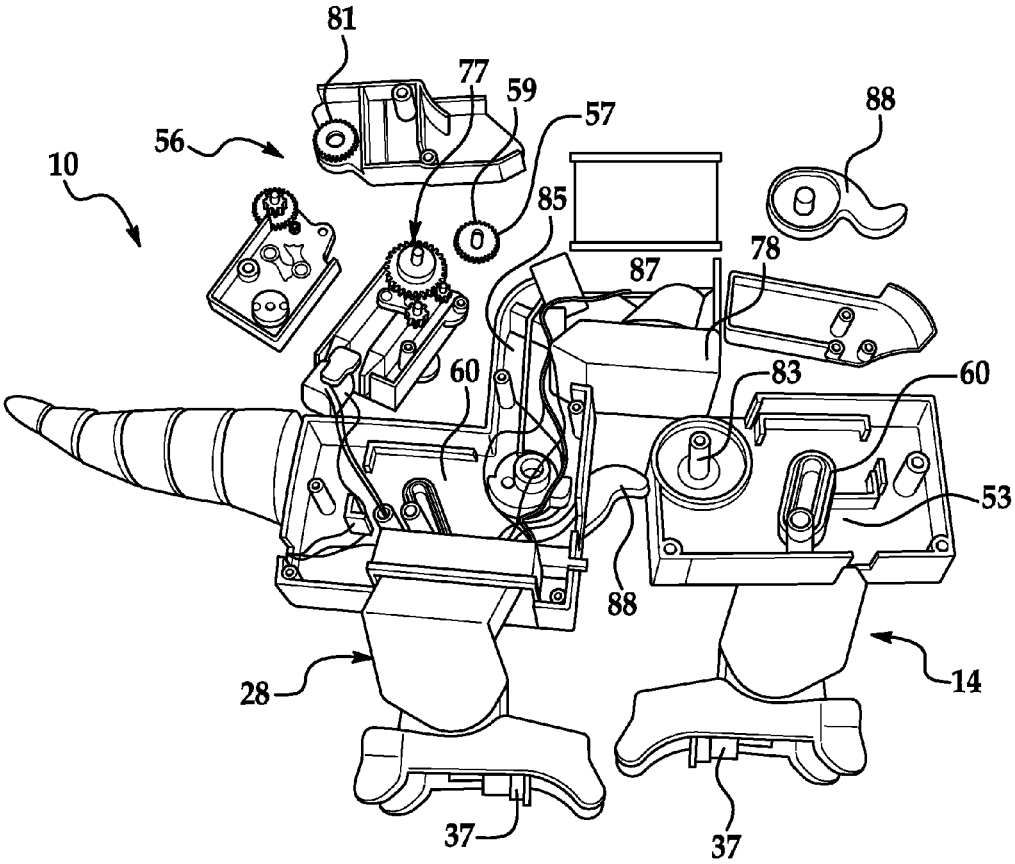
Figure 7E:
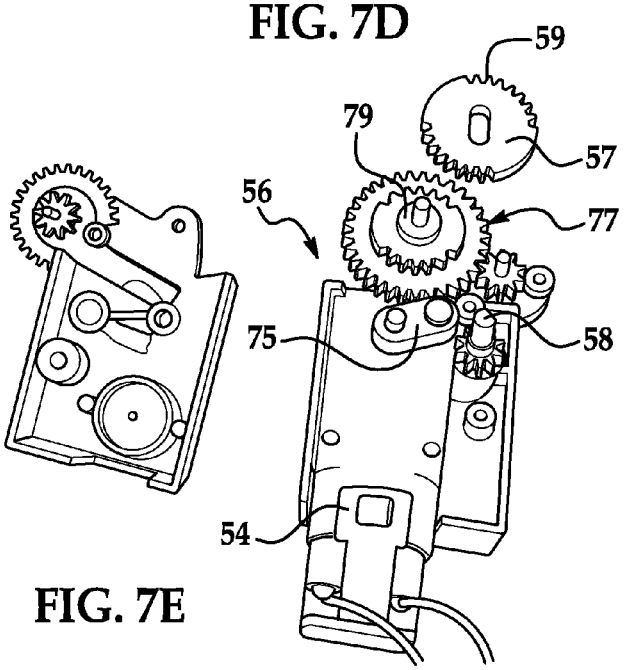
Figure 8A:
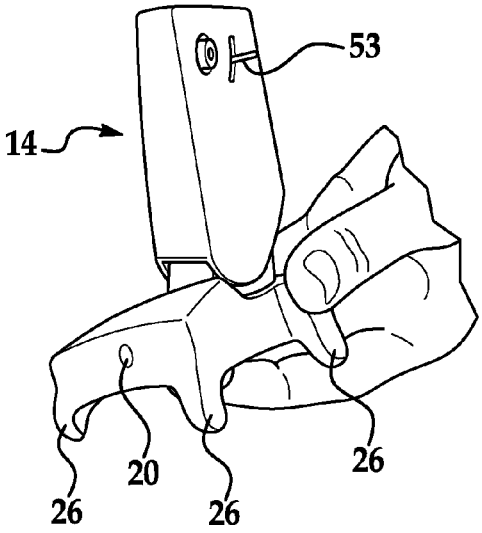
FIGS. 8A-8E illustrate pivotal movement of a foot of the toy in accordance with one embodiment of the present invention.
Figure 8B:
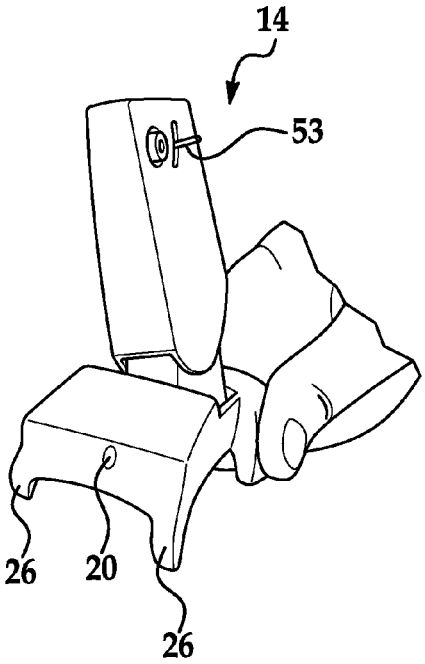
Figure 8C:
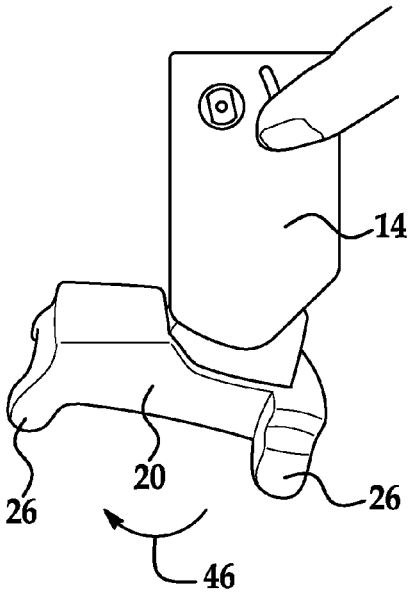
Figure 8D:
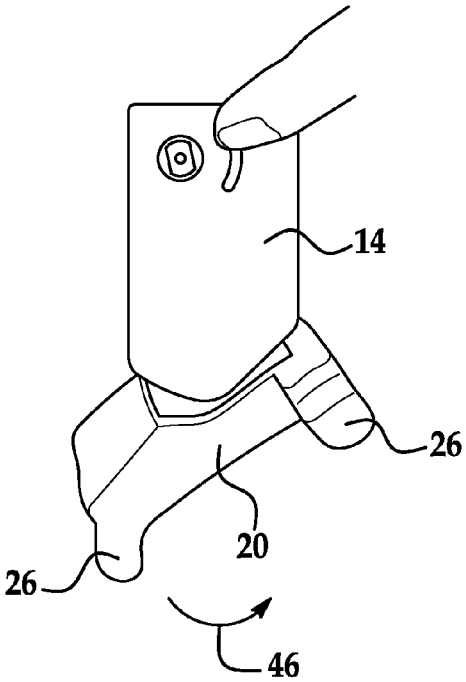
Figure 8E:
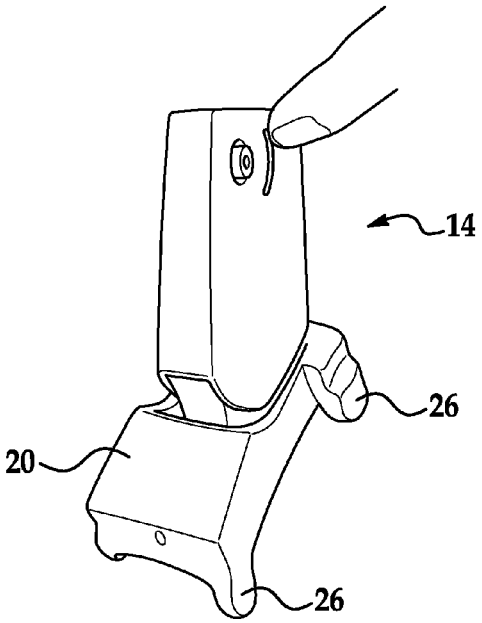
Figure 9:
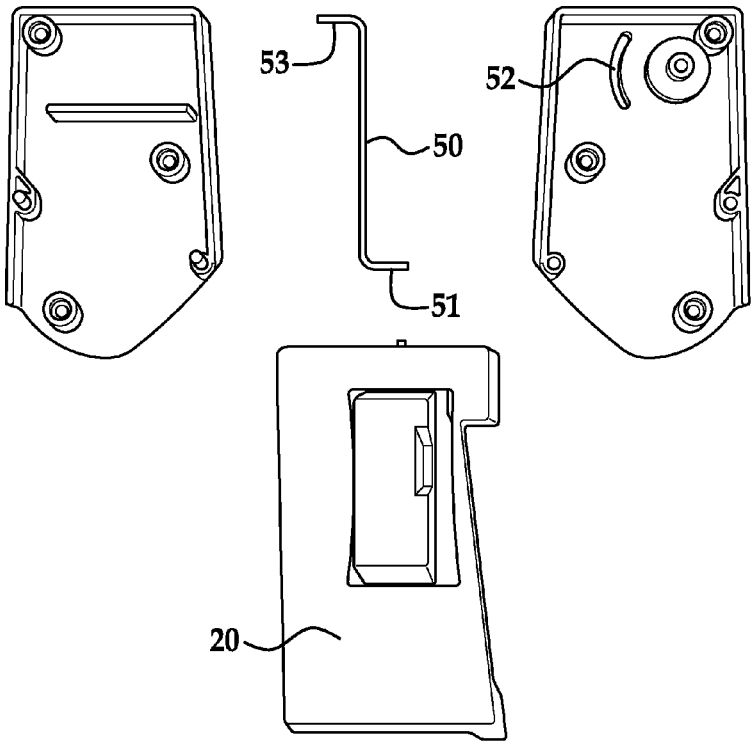
FIG. 9 is an exploded view of a leg and foot in accordance with one embodiment of the present invention.
Figure 10:
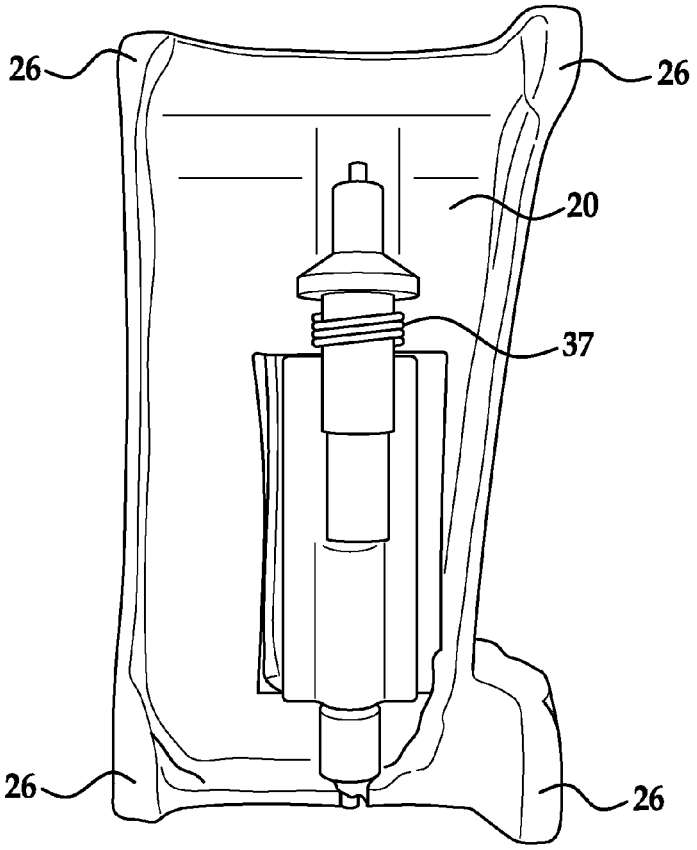
FIG. 10 is a bottom view of a foot in accordance with one embodiment of the present invention.

Referring now to the attached FIGS., toy 10 has a main body portion 12 and a first or right leg 14 pivotally secured to the main body portion for reciprocating movement between a forward position 16 (see at least FIGS. 4A and 6A) and a rearward position 18 (see at least FIG. 4B) with respect to the main body portion. The first or right leg has a first foot or right foot 20 pivotally secured to the first leg. In one embodiment and as illustrated in at least FIGS. 2A, 8A the first foot is configured to incline downwardly in the direction of arrow 22 away from a first side 24 of the main body portion. The downward inclination of each of the feet and their pivotal securement to the toy's legs allows for the center of mass to be intermittingly aligned with the left and right foot as the toy walks or moves forward due to movement of the legs.

In one non-limiting embodiment, the downward inclination is provided by a plurality of protrusions 26 disposed on a bottom of the foot wherein the protrusions are of varying height such that the downward inclination is provided.

Toy 10 also has a second leg or left leg 28 pivotally secured to the main body portion for reciprocating movement between a forward position and a rearward position with respect to the main body portion. Similar to the first leg the second leg has a second foot or left foot 30 pivotally secured to the second leg and in one embodiment and as illustrated at least in FIG. 2A, the second foot is configured to incline downwardly in the direction of arrow 32 away from a second side 34 of the main body portion. Again, the downward inclination is provided by a plurality of protrusions 36 disposed on a bottom of the foot wherein the protrusions are of varying height such that the downward inclination is provided.

Figure 2B:
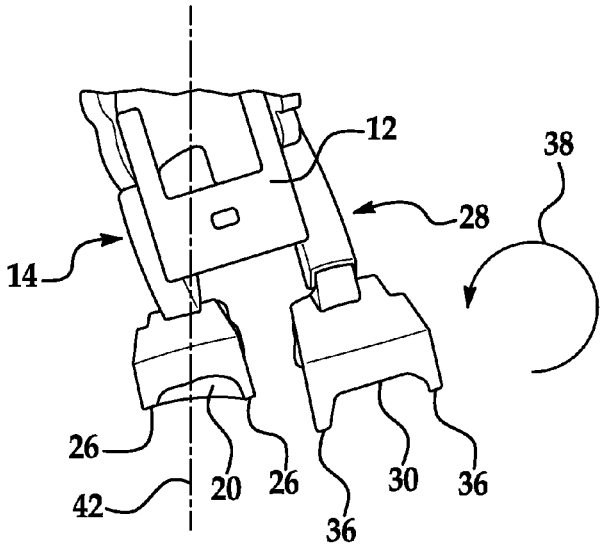
Figure 2C:
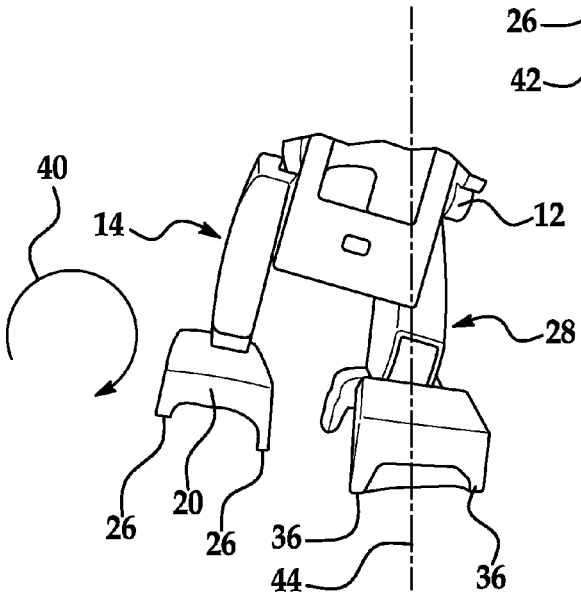
Figure 5:
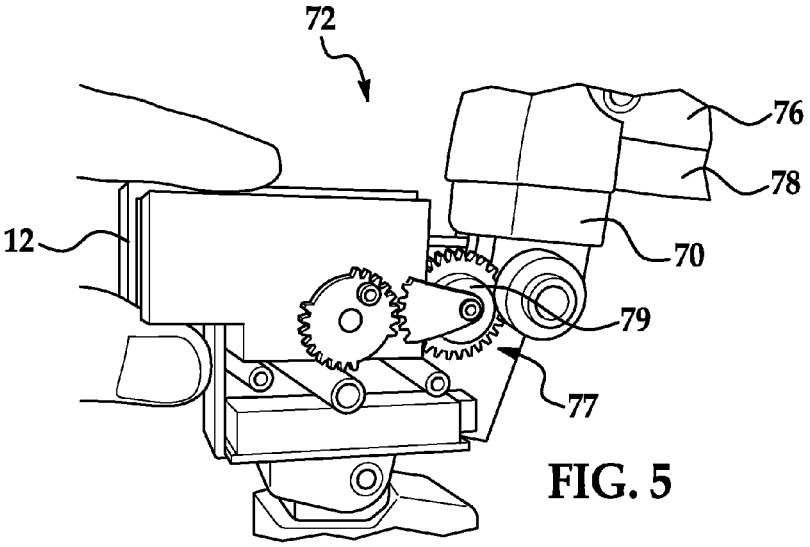
FIG. 5 is a view of components of the toy constructed in an exemplary embodiment of the present invention.

Referring now to at least FIGS. 2B and 2C each foot is spring biased by a spring 37 in the directions of arrows 38 and 40 with respect to its associated leg by a spring member 42 located in each foot. Furthermore, each foot is pivotally/movably secured to the leg for movement in the direction of arrows 38 and 40 as well as directions opposite to those of arrows 38 and 40, such that a center of mass of the toy is intermittently aligned with and supported solely by either the first foot or the second foot as the first leg and the second leg move between the forward position and the rearward position.

This alignment is at least illustrated in FIGS. 1C-1E, 2B and 2C by lines 42 and 44. Moreover and as the legs are lifted and the toy is supported by one of the feet, the pivotal movement of the free foot (e.g., foot not currently supporting the toy) as well as the supporting foot allows the same to adsorb or dampen oscillating forces of the toy as the center of mass of the toy is shifted to the left and right and intermittently aligned with and supported solely by either the first foot or the second foot and as the first leg and the second leg move between the forward position and the rearward position.

In addition, both the first foot and the second foot are pivotally secured to their respective leg portion such that pivotal or rotational movement forward and rearward with respect to the leg portion in the direction of arrows 46 and 48 is provided. This movement allows for the rearward and forward movement of the legs as the toy walks. In one embodiment, this movement of the foot with respect to the leg is achieved through a linkage member 50 that is secured to the foot at one end 51 and the main body portion at another end 53. This portion of the linkage member slides in an opening 52 in the leg in order to pivot the foot forward and rearward as the leg moves forward and rearward with respect to the main body portion. This linkage keeps the feet parallel with floor as legs move.

The spring members and the linkage members allow the toy's weight to shift over the foot that is on the ground and then shift the figure's weight back to the opposite foot during walking action.

In order to drive the legs forward and rearward, a bidirectional motor 54 is provided in the main body portion. The bidirectional motor is coupled to a drive train 56 configured to move the legs when the bidirectional motor is driven in a first direction. As illustrated, the drive train is secured to the motor at one end and the legs at the other end. In one non-limiting exemplary embodiment, the drive train has a feature or axle 58 that extends across the right/left hips/sides of the main body portion or torso and terminating at left and right gears 57 with hip cams 59. Each hip cam 59 being in opposed orientations (e.g., 180 degrees out of sync) such that as they are rotated, the legs move in a bipedal manner (e.g., one forward and one rearward).

The hip cams are slidably received within a pair of slotted cam followers or members 60 pivotally secured to each side of the main body portion such that as axle 58 rotates gear 57 and the slotted members pivot back and forth in the direction of arrows 64 via movement of the hip cams 59 on gears 57.

Each slotted member is fixedly secured to a respective leg such that as each slotted member pivots or rotates back and forth the leg member moves forward and rearward with respect to the main body portion. In addition and as the legs move back and forth, the securement of end 53 of the linkage member in the main body portion causes the desired movement of the feet as the legs of the toy walk in a bipedal manner.

Although one specific gear train is illustrated as being coupled to the motor for driving the legs back and forth it is, of course, understood that numerous equivalent gear trains and means or motors for driving the gear trains and the legs back and forth are contemplated to be within the scope of the present invention and exemplary embodiments of the present invention are not intended to be limited to the specific motor and/or drive train illustrated herein.

The toy also has a neck member 70 pivotally secured to the main body portion for movement between an upright position 72 and an extended position 74. In one non-limiting embodiment, the neck member is driven back and forth from the upright position to the extended position by the bidirectional motor and the drive train when the bidirectional motor is operating in a second direction, the second direction being opposite to the first direction.

Coupled to the neck member is a head portion 76. The head portion has a jaw portion 78 pivotally secured to the head portion for movement between an open position 80, which corresponds to the extended position and a closed position 82, which corresponds to the upright position. Accordingly and as the neck member is driven to the extended position, the jaw portion moves to the open position and as the neck member moves to the upright position the jaw member moves to the closed position.

In one embodiment, the gear train that is driven by the bidirectional motor also ends with a swing gear 75 and the swing gear engages a compound neck gear 77 and a second gear 79 of the compound neck gear is a partial gear (same axis, but teeth over only approximately 75 degrees) that the drives neck/jaw in a cyclic motion. Accordingly and when engaged, the partial gear 79 twists a spring return forward gear 81 mounted to the neck that pivots the neck forward.

In addition, the neck mechanism also includes an internal neck anchor 83 at the base of the neck and fixedly mounted to the torso or main body portion that has wire linkages 85, 87 attached thereto. Accordingly and as the neck pivots forward or to the extended position, the forward and rear wire neck linkages 85, 87 keep an upper head portion 89 horizontal and drive the lower jaw 78 open. When the last tooth of the partial gear releases (e.g., neck is at a maximum forward rotational position) a neck pivot spring returns the neck to an upright neck position, and the mouth closes.

Accordingly and as the motor is driven in a first direction, the motor drives the toy's walking mechanism and the legs alternate in bi-pedal walking action to move the toy forward.

Thereafter and as the motor is driven in a second direction opposite to the first direction, the bidirectional motor drives the neck/jaw mechanism and the neck member cycles forward and backward with the lower jaw opening and closing. Alternatively, the toy can be configured without the neck/jaw mechanism and only the walking mechanism is incorporated into the toy.

The toy also includes a flexible appendage or tail 82 secured to the main body portion. In one non-limiting embodiment, the tail comprises a plurality of members 84 secured to a flexible member 86 that has one end secured to the main body portion or torso of the toy in order to provide flexible motion of the tail. In one non-limiting embodiment, the tail consists of six links or members 84 that allow the tail to swing back and forth (e.g., side to side or left to right and right to left) during motion/walking of the toy as the center of mass of the toy is intermittently aligned with the left and right feet of the toy. Of course, numerous other configurations are considered to be within the scope of exemplary embodiments of the present invention.

In addition and in one embodiment, the toy has two arms 88 on sides of torso/main body portion that can be re-positioned. In one non-limiting configuration, the toy is shaped as a dinosaur. Of course, any other configuration (e.g., character, action figure, animal, robot, etc.) is considered to be with the scope of the embodiments of the present invention.

Referring now to FIGS. and as the legs of the toy are independently driven forward and rearward, the center of mass of the toy shifts to the foot supporting the toy while the other non weight supporting foot and leg traverses forwardly with respect to the main body portion and the supporting foot and leg traverses rearwardly with respect to the main body portion until the weight and center of mass has shifted accordingly. As discussed herein, this weight shifting is facilitated by the pivotal securement of the foot to the leg, the spring biasing of the foot and the inclined configuration of the foot such that the center of mass of the toy may move back and forth over the left foot and the right foot. In other words, the toy rocks or moves back and forth (e.g., left to right and right to left with respect to forward movement) as the legs are moved forward and rearward to cause the toy to move or walk along a surface. Moreover and as discussed herein, the right foot and the left foot also dampen oscillating forces of the toy as the center of mass of the toy is intermittently aligned with and supported solely by either the right foot or the left foot and as the right leg and the left leg move between the forward position and the rearward position. This is facilitated by the pivotal or movable securement of the feet to the legs of the toy. Still further, the back and forth movement of the center of mass provides a realistic aspect to the toy as it moves along a surface in that the back and forth movement resembles that of a real creature moving in a bipedal manner.

In addition and in order to balance and shift the center of mass of the toy to the left foot and the right foot, small weights such as brass weights 91 are located within the main body portion or any other equivalent body portion to shift the weight accordingly. In addition, a battery 90, for powering the motor and associated battery compartment 92, is centrally located for balancing the toy as it walks.

As used herein, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

What is claimed is:

1. A toy, comprising:

a main body portion;

a first leg pivotally secured to the main body portion for reciprocating movement between a forward position and a rearward position with respect to the main body portion;

a first foot pivotally secured to the first leg;

a second leg pivotally secured to the main body portion for reciprocating movement between a forward position and a rearward position with respect to the main body portion; and a second foot pivotally secured to the second leg, wherein the first foot is spring biased against the first leg and the second foot is spring biased against the second leg such that a center of mass of the toy is displaced horizontally with respect to the main body portion and intermittently aligned with and supported solely by either the first foot or the second foot as the first leg and the second leg move between the forward position and the rearward position.

2. The toy as in claim 1, further comprising a motor for moving the first leg and the second leg between the forward position and the rearward position and wherein the first foot and the second foot dampen oscillating forces of the toy as the center of mass of the toy is intermittently aligned with and supported solely by either the first foot or the second foot and as the first leg and the second leg move between the forward position and the rearward position.

3. The toy as in claim 1, wherein the first leg is pivotally secured to a first side of the main body portion and the second leg is pivotally secured to a second side of the main body portion, the first leg and the second leg being on opposing sides of the main body portion and wherein the first foot is configured to incline downwardly away from the first side of the main body portion and the second foot is configured to incline downwardly away from the second side of the main body portion.

4. The toy as in claim 1, further comprising a flexible appendage movably secured to the main body portion.

5. The toy as in claim 1, further comprising a neck member pivotally secured to the main body portion for movement between an upright position and an extended position.

6. A toy, comprising:

a main body portion;

a first leg pivotally secured to the main body portion for reciprocating movement between a forward position and a rearward position with respect to the main body portion;

a first foot pivotally secured to the first leg;

a second leg pivotally secured to the main body portion for reciprocating movement between a forward position and a rearward position with respect to the main body portion;

a second foot pivotally secured to the second leg, wherein the first foot is spring biased with respect to the first leg and the second foot is spring biased with respect to the second leg such that a center of mass of the toy is intermittently aligned with and supported solely by either the first foot or the second foot as the first leg and the second leg move between the forward position and the rearward position;

a neck member pivotally secured to the main body portion for movement between an upright position and an extended position; and a motor for moving the first leg and the second leg between the forward position and the rearward position when the motor is operating in a first direction and the motor moves the neck member between the upright position and the extended position when the motor is operating in a second direction, the second direction being opposite to the first direction.

7. The toy as in claim 6, further comprising a flexible appendage secured to the main body portion and wherein the first leg is pivotally secured to a first side of the main body portion and the second leg is pivotally secured to a second side of the main body portion, the first leg and the second leg being on opposing sides of the main body portion.

8. The toy as in claim 7, wherein the toy is shaped as a dinosaur.

9. The toy as in claim 6, further comprising a head portion secured to the neck member, the head portion further comprising a jaw portion pivotally secured to the head portion for movement between an open position and a closed position, the jaw portion moving to the open position from the closed position as the neck member moves from the upright position to the extended position.

10. A toy, comprising:

a main body portion;

a first leg pivotally secured to the main body portion for reciprocating movement between a forward position and a rearward position with respect to the main body portion;

a first foot pivotally secured to the first leg;

a second leg pivotally secured to the main body portion for reciprocating movement between a forward position and a rearward position with respect to the main body portion;

a second foot pivotally secured to the second leg, wherein the first foot is spring biased with respect to the first leg and the second foot is spring biased with respect to the second leg such that a center of mass of the toy is intermittently aligned with and supported solely by either the first foot or the second foot as the first leg and the second leg move between the forward position and the rearward position;

a neck member pivotally secured to the main body portion for movement between an upright position and an extended position;

a motor for moving the first leg and the second leg between the forward position and the rearward position when the motor is operating in a first direction and for moving the neck member between the upright position and the extended position when the motor is operating in a second direction, the second direction being opposite to the first direction, the second direction being opposite to the first direction; and a gear train coupled to the first leg and the second leg at one end and the motor at another end.

11. The toy as in claim 10, further comprising a flexible appendage secured to the main body portion and wherein the first leg is pivotally secured to a first side of the main body portion and the second leg is pivotally secured to a second side of the main body portion, the first leg and the second leg being on opposing sides of the main body portion.

12. The toy as in claim 11, wherein the toy is shaped as a dinosaur.

13. The toy as in claim 12, further comprising a head portion secured to the neck member, the head portion further comprising a jaw portion pivotally secured to the head portion for movement between an open position and a closed position, the jaw portion moving to the open position from the closed position as the neck member moves from the upright position to the extended position.

* * * * *